US011730284B2

(12) United States Patent
Yang

(10) Patent No.: US 11,730,284 B2
(45) Date of Patent: Aug. 22, 2023

(54) MULTIPURPOSE BASSINET

(71) Applicant: XIAMEN BABY PRETTY PRODUCTS CO., LTD., Xiamen (CN)

(72) Inventor: Jianbo Yang, Xiamen (CN)

(73) Assignee: XIAMEN BABY PRETTY PRODUCTS CO., LTD., Xiamen (CN)

( * ) Notice: Subject to any disclaimer, the term of this patent is extended or adjusted under 35 U.S.C. 154(b) by 0 days.

(21) Appl. No.: 17/515,526

(22) Filed: Oct. 31, 2021

(65) Prior Publication Data

US 2022/0330713 A1 Oct. 20, 2022

(30) Foreign Application Priority Data

Apr. 18, 2021 (CN) ..... 202120788410.2

(51) Int. Cl.
*A47D 9/00* (2006.01)

(52) U.S. Cl.
CPC ..... *A47D 9/00* (2013.01)

(58) Field of Classification Search
CPC . A47D 9/00; A47D 9/012; A47D 9/04; A47D 7/01; A47D 7/02; A47D 7/03
See application file for complete search history.

(56) References Cited

U.S. PATENT DOCUMENTS

2010/0000016 A1* 1/2010 Aiken ..... A47D 7/01 5/93.1
2018/0192784 A1* 7/2018 Yang ..... A47D 7/01
2020/0046141 A1* 2/2020 Mu ..... A47D 9/00

FOREIGN PATENT DOCUMENTS

CN 107307680 A * 11/2017 ..... A47D 7/01

* cited by examiner

*Primary Examiner* — David R Hare
*Assistant Examiner* — Adam C Ortiz
(74) *Attorney, Agent, or Firm* — Bayramoglu Law Offices LLC

(57) ABSTRACT

A multipurpose bassinet includes a left support part and a right support part that are symmetrical. The left support part and the right support part each include a base, a support rod, a sleeve rod and a sleeping basket. The bottom of the support rod is connected to the top of the base. A lower part of the sleeve rod is sleeved on an upper part of the support rod. An upper part of the sleeve rod is provided with a lift button that drives the sleeve rod to ascend and descend on the support rod. The sleeping basket is provided between the sleeve rod of the left support part and the sleeve rod of the right support part. The upper part of the sleeve rod is provided with an elastic lock member for locking the lift button.

5 Claims, 18 Drawing Sheets

MULTIPURPOSE BASSINET

CROSS REFERENCE TO THE RELATED APPLICATIONS

This application is based upon and claims priority to Chinese Patent Application No. 202120788410.2 filed on Apr. 18, 2021, the entire contents of which are incorporated herein by reference.

TECHNICAL FIELD

The present invention relates to the field of children's products, in particular to a multipurpose bassinet.

BACKGROUND

Bassinets are specially designed for infants. The existing bassinets have various styles, functions and prices, including fixed type bassinets and cradle type bassinets. However, the overall height of the existing bassinets, basically, is not adjustable according to the actual situation, resulting in that parents must bend over to scoop the baby up.

A height-adjustable bassinet in the prior art includes a left support part and a right support part that are symmetrical. The left support part and the right support part each include a base, two support rods, a sleeve rod and a sleeping basket. The bottoms of the two support rods are connected to the top of the base. The lower part of the sleeve rod are sleeved on the upper parts of the two support rods. The upper part of the sleeve rod is provided with a button that drives the sleeve rod to ascend and descend along the two support rods. The sleeping basket is provided between the sleeve rod of the left support part and the sleeve rod of the right support part. The button can drive the sleeve rod to ascend and descend on the two support rods, thereby driving the sleeping basket to ascend and descend. However, the button is not provided with an additional safety component, which is prone to being incorrectly touched by the elderly or baby, thereby causing a safety hazard.

SUMMARY

In order to solve the above-mentioned problems existing in the prior art, an objective of the present invention provides a multipurpose bassinet.

The present invention is implemented by the following technical solution:

A multipurpose bassinet includes a left support part and a right support part that are symmetrical, where the left support part and the right support part each include a base, a support rod, a sleeve rod and a sleeping basket; the bottom of the support rod is connected to the top of the base; a lower part of the sleeve rod is sleeved on an upper part of the support rod; an upper part of the sleeve rod is provided with a lift button that drives the sleeve rod to ascend and descend on the support rod; the sleeping basket is provided between the sleeve rod of the left support part and the sleeve rod of the right support part; the upper part of the sleeve rod is provided with an elastic lock member for locking the lift button; the lock member is movable in left and right directions; and the lock member is pressed to unlock the lift button.

Further, the sleeve rod may have an inner hollow structure; a side surface of the sleeve rod may be provided with a button port; the upper part of the sleeve rod may be provided therein with a baffle connected to the button port; the height of the baffle may be less than that of the button port; the lift button may be provided in the upper part of the sleeve rod; the lift button may include a button part and a baffle part; the button part may be located above the baffle, and a bottom surface of the button part may be able to abut against a top surface of the baffle; the baffle part may be connected to the button part and may be located inside the baffle; the baffle part may be provided with a movable space; an inner side surface of the baffle part may be provided with two symmetrical support plates; the two support plates may be respectively located on two sides of the movable space; the baffle may be provided with a through groove that may be adapted to the lock member; the through groove may be communicated with the movable space; one end of the lock member passes through the through groove and the movable space, and the other end of the lock member may be located outside the through groove; one end of the lock member may be provided with two symmetrical clamping parts; bottom surfaces of the two clamping parts may respectively abut against top surfaces of the two support plates; a first spring hole may be provided in the middle of one end of the lock member; and a first spring may be provided between the first spring hole and an inner side surface of the sleeve rod.

Further, a housing may be fixedly provided at the bottom of the sleeve rod; a lifting block and a clamping block may be provided in the housing; the lifting block may be used to drive the clamping block to move in left and right directions; an outer side surface of the clamping block may be provided with a clamping plate; an inner side surface of the support rod may be provided with multiple clamping openings that may be spaced apart vertically for one end of the clamping plate to be clamped into; a pull rope may be provided between the baffle part and the lifting block; a top surface of the lifting block may be provided with a second spring hole; an inner top surface of the housing may be provided with a spring mounting part; and a second spring may be provided between the spring mounting part and the second spring hole.

Further, the lifting block may include a head part and a driving part; a junction of the head part and the driving part may be a bending part; a rear side surface of the bending part may be a first inclined surface; a top surface of the clamping block may be a second inclined surface that may fit the first inclined surface; a top front side surface of the clamping block may be provided with a protruding part; a bottom surface of the protruding part may be a third inclined surface; an outer side surface of the protruding part may abut against an inner side surface of the driving part; the inner side surface of the driving part may be provided with a fourth inclined surface that may fit the third inclined surface; a third spring hole may be provided on an inner side surface of the clamping block; a third spring may be provided between the third spring hole and the inner side surface of the housing; a limit plate may be provided on a lower front side surface of the clamping block; the limit plate may be located below the driving part; the second spring hole may be provided on the head part; and the pull rope may be provided between the baffle part and the head part.

Further, the sleeping basket may include a left front bending tube, a right front bending tube, a rear bending tube, a lifting tube, a support frame, a left guide rail and a right guide rail; the rear bending tube may be connected between an upper rear end of the sleeve rod of the left support part and an upper rear end of the sleeve rod of the right support part; one end of the left front bending tube may be connected to an upper front end of the sleeve rod of the left support part, and the other end of the left front bending tube may be connected to a top left end of the left guide rail; one end of the right front bending tube may be connected to an upper front end of the sleeve rod of the right support part, and the other end of the right front bending tube may be connected to a top right end of the right guide rail; the bottom of the left guide rail and the bottom of the right guide rail may be respectively connected to the support frame; an inner side surface of the left guide rail and an inner side surface of the right guide rail may be respectively provided with a lifting member; the lifting tube may be provided between the lifting member of the left guide rail and the lifting member of the right guide rail; the inner side surface of the sleeve rod of each of the left support part and the right support part may be provided with a first sleeve; left and right ends of the support frame may be respectively provided with a connecting rod; correspondingly, the first sleeve may be sleeved on the connecting rod; and the first sleeve may be connected to the inner side surface of the corresponding sleeve rod.

Further, a bottom inner side surface of the sleeve rod may be provided with a first sleeve part, and the first sleeve may be sleeved on the first sleeve part.

Further, the base may include a support seat, a support sleeve tube and a support table; the support sleeve tube may be provided on a top surface of the support seat; the bottom of the support table may be provided with an opening groove; an upper part of the support sleeve tube may be clamped in the opening groove; an inner side surface of the support seat may be provided with two lower hinge lugs; an inner side surface of the support table may be provided with two upper hinge lugs that may be respectively hinged to the two lower hinge lugs; a bottom surface of the support seat may be a recessed arc surface; the inner side surface of the support table may be further provided with a second sleeve; and a reinforcing rod may be provided between the second sleeve on the left support part and the second sleeve on the right support part.

Further, the inner side surface of the support table may be provided with a second sleeve part, and the second sleeve may be sleeved on the second sleeve part.

Further, one end of the support sleeve tube may be provided therein with a telescopic inner tube; one end of the inner tube may be provided with a universal wheel connecting part; the other end of the support sleeve tube may be also provided with a universal wheel connecting part; the universal wheel connecting part may be provided with a universal wheel; the support sleeve tube may be provided therein with a compression spring along a length direction; the compression spring may be located between the universal wheel connecting part on the other end of the support sleeve tube and the other end of the inner tube; the other end of the inner tube may be provided therein with a V-shaped elastic piece; an inner side surface of the V-shaped elastic piece may be provided with a clamping bead; an inner side surface of the other end of the inner tube may be provided with a clamping hole for the clamping bead to extend outward; the clamping bead may be located outside one end of the support sleeve tube; an inner side surface of the universal wheel connecting part on one end of the inner tube may be provided with a connecting post that may be L-shaped in a top view; an inner end of the connecting post may be provided with a frustum part; a transverse part of the connecting post may be provided with a cut; the cut divides the transverse part and the frustum part of the connecting post into two halves, respectively; an inner side surface of one end of the support sleeve tube may be provided with a lug; and the lug may be provided with a circular hole for inserting the two halves of the frustum part.

Further, the sleeping basket may be provided with a cloth cover; the cloth cover may include a front cloth cover and a rear cloth cover; the rear cloth cover may be connected to the left front bending tube, the right front bending tube, the rear bending tube and the support frame; an upper part of the front cloth cover may be sleeved on the lifting tube; left and right ends of the front cloth cover may be respectively provided with a left zipper belt and a right zipper belt; the left zipper belt and the right zipper belt may be respectively provided with zipper teeth; the left guide rail and the right guide rail may respectively have a hollow structure; the left guide rail and the right guide rail may be respectively provided therein with a partition; the partition may be provided with a first cut from top to bottom along a height direction; the inner side surface of the left guide rail and the inner side surface of the right guide rail may be respectively provided with a second cut from top to bottom; the left zipper belt and the right zipper belt pass through the corresponding second cut and first cut; the zipper teeth of the left zipper belt and the zipper teeth of the right zipper belt may be respectively located in the left guide rail and the right guide rail; the zipper teeth of the left zipper belt block an outer side of the partition in the left guide rail, and the zipper teeth of the right zipper belt block an outer side of the partition in the right guide rail; the bottom of the front cloth cover may be wound around a front bottom surface of the support frame; the bottom of the front cloth cover may be provided with multiple elastic belts; a rear end of the support frame may be provided with multiple winding members; each winding member corresponds to one elastic belt; each winding member may be provided with a winding hole; one end of each elastic belt may be connected to one side surface of the bottom of the front cloth cover; and the other end of each elastic belt passes through the corresponding winding hole and may be connected to the other side surface of the bottom of the front cloth cover.

The above description of the present invention shows that compared with the prior art, the present invention has the following advantages. The lift button can drive the sleeve rod to ascend and descend on the two support rods, and the sleeping basket is provided between the sleeve rod of the left support part and the sleeve rod of the right support part. Therefore, the sleeve rod of the left support part and the sleeve rod of the right support part move the sleeping basket up and down while they synchronously ascend and descend. Before the lift button is pressed, the lock member must be pressed to unlock the lift button, that is, the lift button can only be pressed after it is unlocked. Therefore, the lock member provides safety guarantee for the lifting of the sleeping basket, and avoids the safety hazard caused by the misoperation of the lift button.

DETAILED DESCRIPTION OF THE EMBODIMENTS

Figure 1:
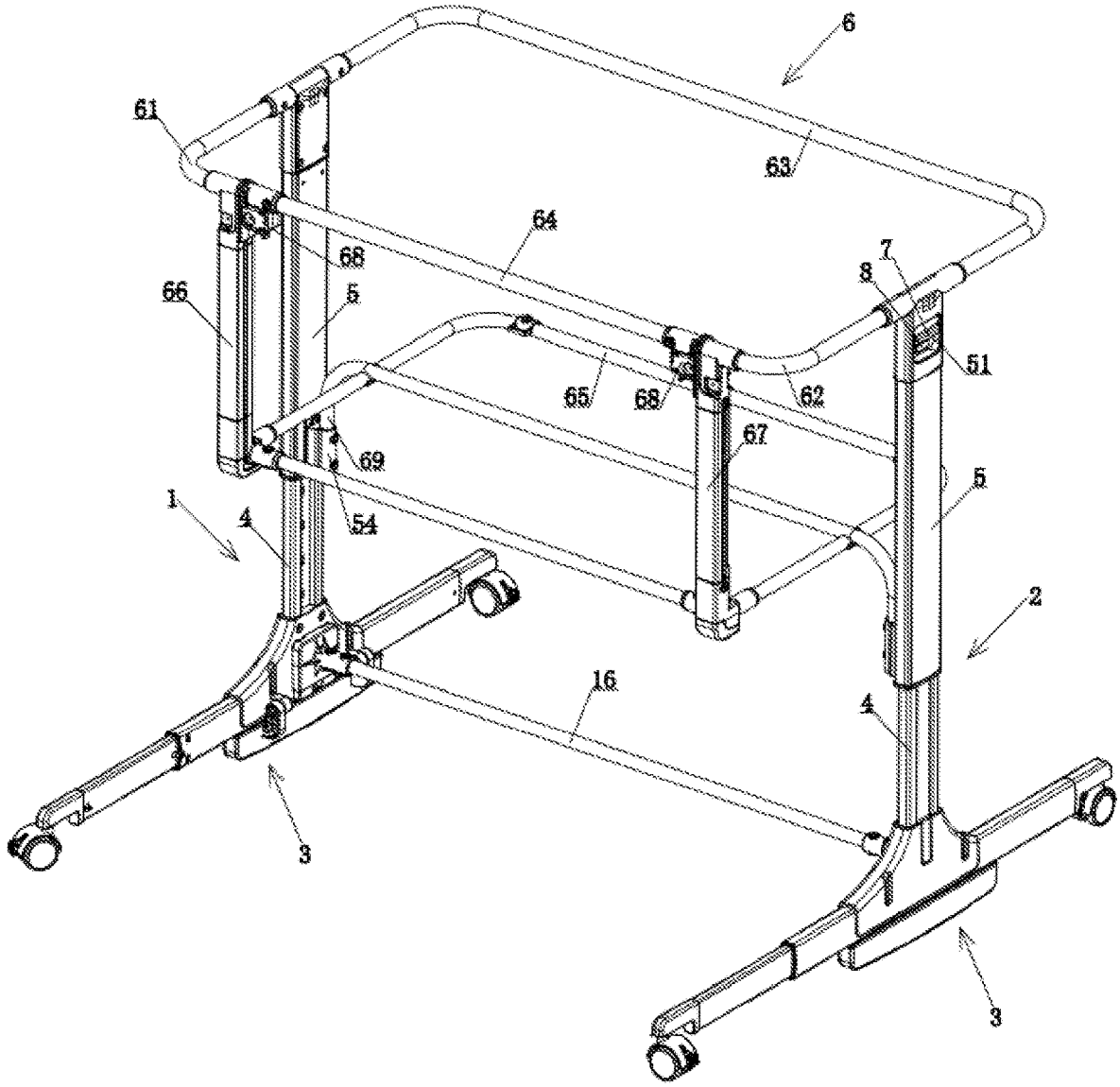
FIG. 1 is a view illustrating a structure after a cloth cover is removed according to the present invention.

Referring to FIG. 1, a multipurpose bassinet includes a left support part 1 and a right support part 2 that are symmetrical. The left support part 1 and the right support part 2 each include a base 3, a support rod 4, a sleeve rod 5 and a sleeping basket 6. The bottom of the support rod 4 is connected to the top of the base 3. A lower part of the sleeve rod 5 is sleeved on an upper part of the support rod 4. An upper part of the sleeve rod 5 is provided with a lift button 7 that drives the sleeve rod 5 to ascend and descend on the support rod 4. The sleeping basket 6 is provided between the sleeve rod 5 of the left support part 1 and the sleeve rod 5 of the right support part 2. The upper part of the sleeve rod 5 is provided with an elastic lock member 8 for locking the lift button 7. The lock member 8 is movable in left and right directions. The lock member 8 is pressed to unlock the lift button 7.

Referring to FIGS. 1, 3, 5 and 6, the sleeve rod 5 has an inner hollow structure. A side surface of the sleeve rod 5 is provided with a button port 51. The upper part of the sleeve rod 5 is provided therein with a baffle 52 connected to the button port 51. The height of the baffle 52 is less than that of the button port 51. The lift button 7 is provided in the upper part of the sleeve rod 5. The lift button 7 includes a button part 71 and a baffle part 72. The lift button 7 is located above the baffle 52, and a bottom surface of the lift button is able to abut against a top surface of the baffle 52. The baffle part 72 is connected to the button part 71 and is located inside the baffle 52. The baffle part 72 is provided with a movable space 73. An inner side surface of the baffle part 72 is provided with two symmetrical support plates 74. The two support plates 74 are respectively located on two sides of the movable space 73. The baffle 52 is provided with a through groove 53 that is adapted to the lock member 8. The through groove 53 is communicated with the movable space 73. One end of the lock member 8 passes through the through groove 53 and the movable space 73, and the other end of the lock member 8 is located outside the through groove 53. One end of the lock member 8 is provided with two symmetrical clamping parts 81. Bottom surfaces of the two clamping parts 81 respectively abut against top surfaces of the two support plates 74. A first spring hole 82 is provided in the middle of one end of the lock member 8. And a first spring (not shown in the figure) is provided between the first spring hole 82 and an inner side surface of the sleeve rod 5.

Referring to FIGS. 2 and 4 to 7, a housing 9 is fixedly provided at the bottom of the sleeve rod 5. A lifting block 10 and a clamping block 11 are provided in the housing 9. The lifting block 10 is used to drive the clamping block 11 to move in left and right directions. An outer side surface of the clamping block 11 is provided with a clamping plate 12. An inner side surface of the support rod 4 is provided with multiple clamping openings 41 that are spaced apart vertically for one end of the clamping plate 12 to be clamped into. A pull rope 13 is provided between the baffle part 72 and the lifting block 10. A top surface of the lifting block 10 is provided with a second spring hole 100. An inner top surface of the housing 9 is provided with a spring mounting part 91. And a second spring 14 is provided between the spring mounting part 91 and the second spring hole 100.

Referring to FIGS. 5 to 8, the lifting block 10 includes a head part 101 and a driving part 102. A junction of the head part 101 and the driving part 102 is a bending part 103. A rear side surface of the bending part 103 is a first inclined surface 104. A top surface of the clamping block 11 is a second inclined surface 111 that fits the first inclined surface 104. A top front side surface of the clamping block 11 is provided with a protruding part 112. A bottom surface of the protruding part 112 is a third inclined surface 113. An outer side surface of the protruding part 112 abuts against an inner side surface of the driving part 102. The inner side surface of the driving part 102 is provided with a fourth inclined surface 105 that fits the third inclined surface 113. A third spring hole 114 is provided on an inner side surface of the clamping block 11. A third spring 15 is provided between the third spring hole 114 and the inner side surface of the housing 9. A limit plate 115 is provided on a lower front side surface of the clamping block 11. The limit plate 115 is located below the driving part 102. The second spring hole 100 is provided on the head part 101. The pull rope 13 is provided between the baffle part 72 and the head part 101.

Referring to FIGS. 1 to 8, when the sleeping basket 6 needs to ascend and descend, the lock member 8 is first pressed inward, such that the two clamping parts 81 of the lock member 8 are separated from the corresponding support plates 74, and the lift button 7 can be pressed upward. When the lift button 7 is pressed upward, the pull rope 13 is pulled upward. When the pull rope 13 is pulled upward, the head part 101 is driven to be lifted up. Due to the cooperation of the first inclined surface 104 and the second inclined surface 111 and the cooperation of the third inclined surface 113 and the fourth inclined surface 105, when the head part 101 is lifted up, the clamping block 11 is driven to move inward, such that the clamping plate 12 is separated from the original matching clamping opening 41. When the sleeping basket 6 is adjusted to a desired height, the lift button 7 is released. Under the action of the second spring 14, the lift button 7 is reset. Under the action of the first spring (not shown in the figure), the lock member 8 is reset to re-lock the lift button 7. Under the action of the third spring 15, the clamping block 11 is reset, and the clamping plate 12 is clamped into a new clamping opening 41.

Figure 2:
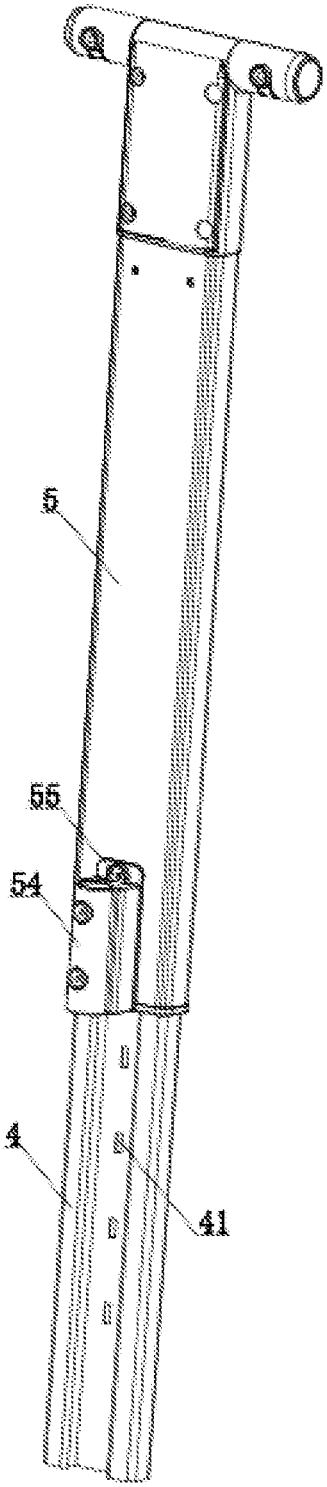
FIG. 2 is a view illustrating a support rod and a sleeve rod that are connected according to the present invention.
Figure 3:
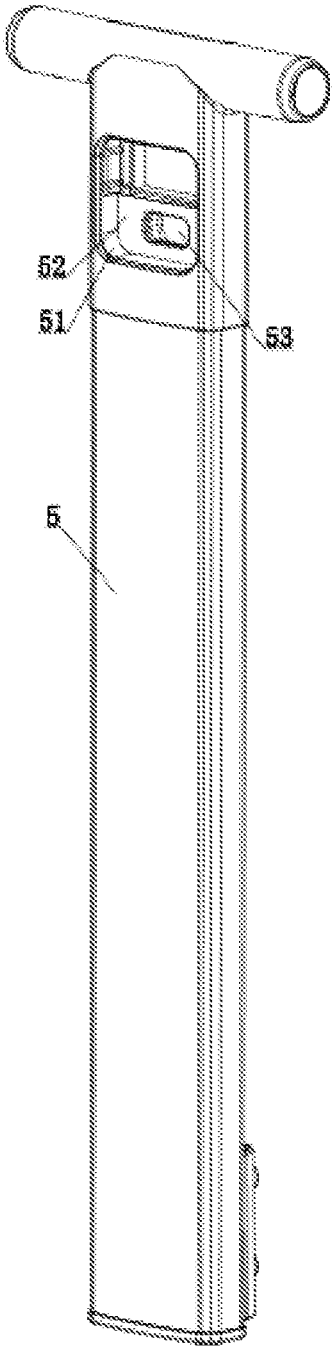
FIG. 3 is a view illustrating a structure of the sleeve rod according to the present invention.
Figure 4:
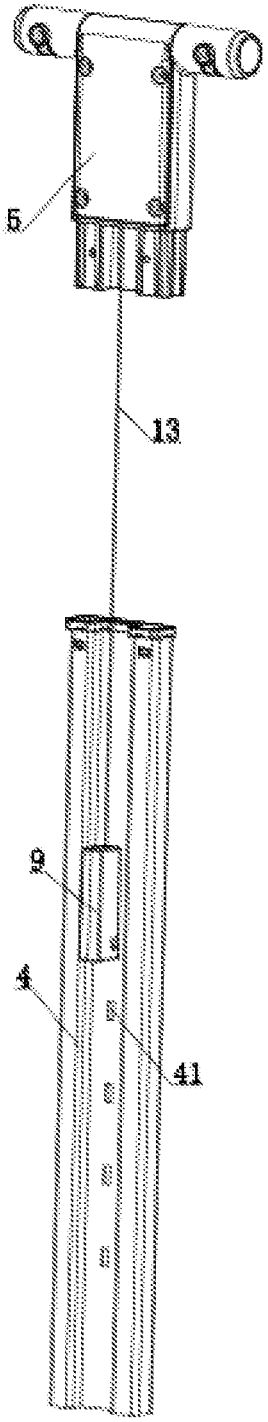
FIG. 4 is a view illustrating the support rod connected to an upper part of the sleeve rod according to the present invention.
Figure 5:
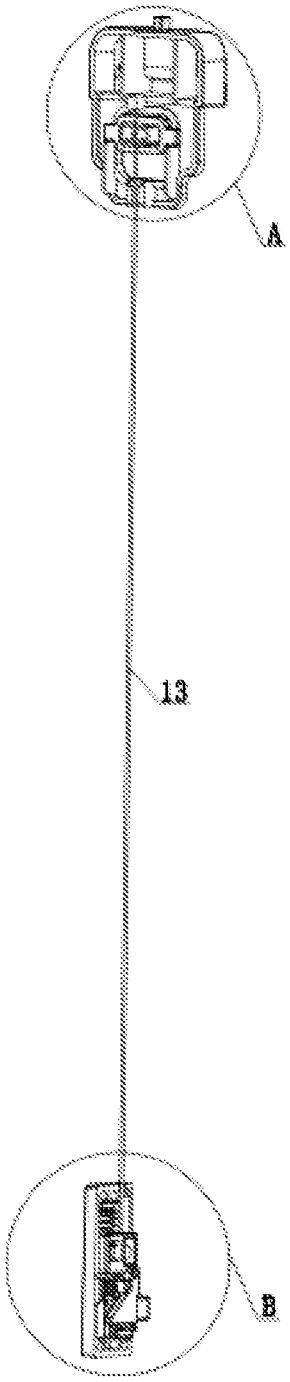
FIG. 5 is a view illustrating a lift button connected to a housing, where part of the housing is not shown in the figure, according to the present invention.
Figure 6:
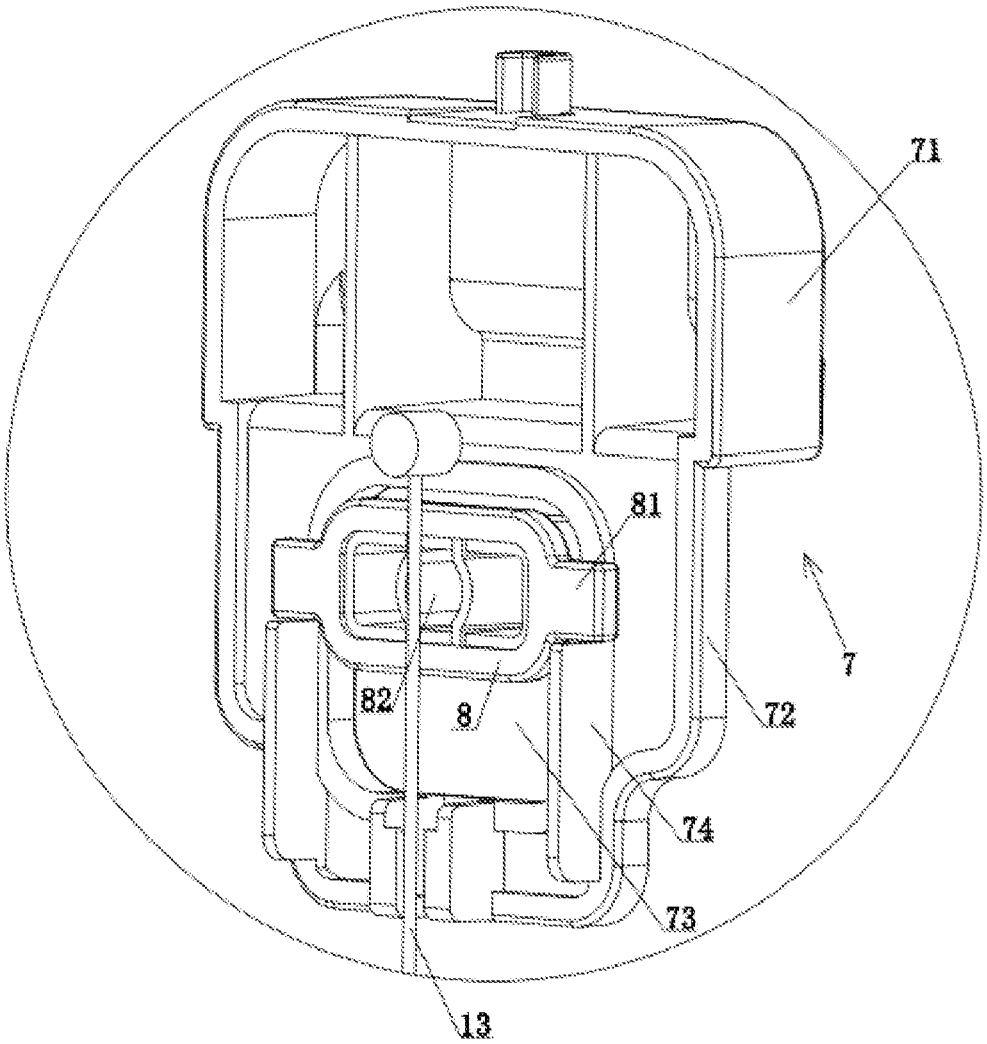
FIG. 6 is a partial enlarged view of A in FIG. 5.
Figure 7:
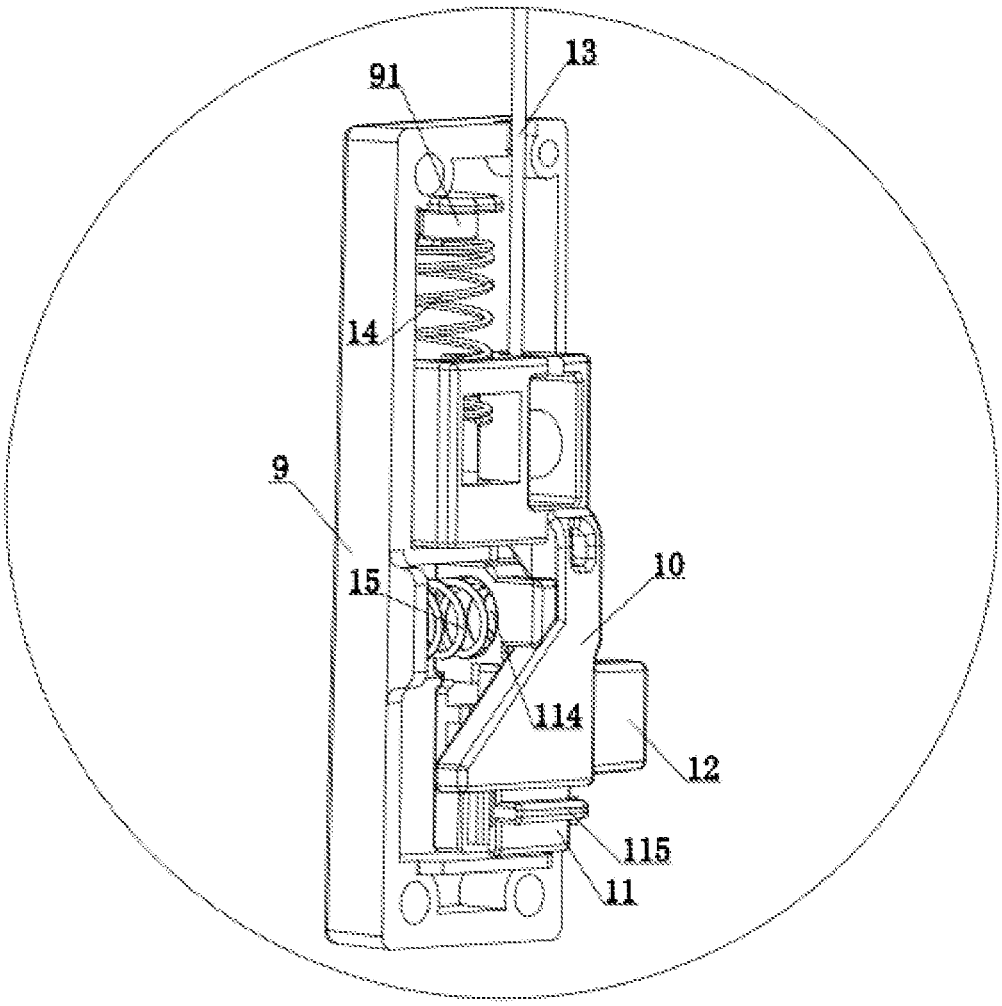
FIG. 7 is a partial enlarged view of B in FIG. 5.
Figure 8:
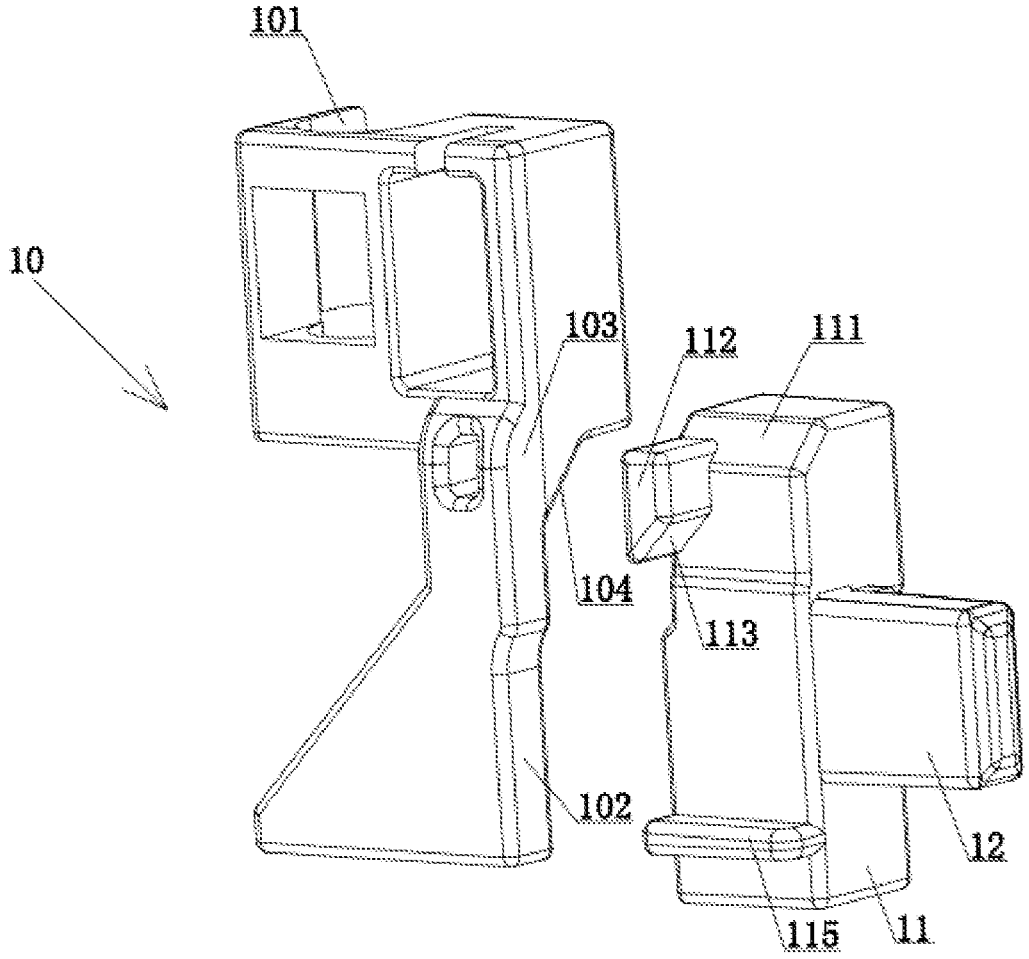
FIG. 8 is an exploded view illustrating structures of a lifting block and a clamping block according to the present invention.

Referring to FIGS. 1 and 2, the sleeping basket 6 includes a left front bending tube 61, a right front bending tube 62, a rear bending tube 63, a lifting tube 64, a support frame 65, a left guide rail 66 and a right guide rail 67. The rear bending tube 63 is connected between an upper rear end of the sleeve rod 5 of the left support part 1 and an upper rear end of the sleeve rod 5 of the right support part 2. One end of the left front bending tube 61 is connected to an upper front end of the sleeve rod 5 of the left support part 1, and the other end of the left front bending tube 61 is connected to a top left end of the left guide rail 66. One end of the right front bending tube 62 is connected to an upper front end of the sleeve rod 5 of the right support part 2, and the other end of the right front bending tube 62 is connected to a top right end of the right guide rail 67. The bottom of the left guide rail 66 and the bottom of the right guide rail 67 are respectively connected to the support frame 65. An inner side surface of the left guide rail 66 and an inner side surface of the right guide rail 67 are respectively provided with a lifting member 68. The lifting tube 64 is provided between the lifting member 68 of the left guide rail 66 and the lifting member 68 of the right guide rail 67. The connection manner of the lifting members 68 to the left guide rail 66 and the right guide rail 67 and the lifting manner of the lifting members 68 are existing manners, which will not be repeated here. The inner side surface of the sleeve rod 5 of each of the left support part 1 and the right support part 2 is provided with a first sleeve 54. Left and right ends of the support frame 65 are respectively provided with a connecting rod 69. Correspondingly, the first sleeve 54 is sleeved on the connecting rod 69. The first sleeve 54 is connected to the inner side surface of the corresponding sleeve rod 5. Specifically, the bottom inner side surface of the sleeve rod 5 is provided with the first sleeve part 55, and the first sleeve 54 is sleeved on the first sleeve part 55. The first sleeve 54 may be sleeved on the first sleeve part 55 through an I-slot, which is convenient for disassembly and assembly.

Figure 9:
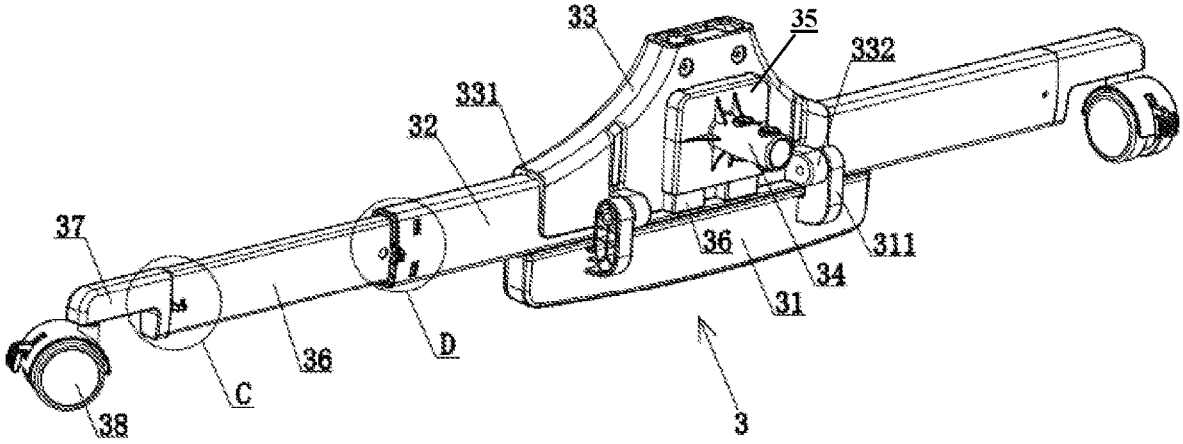
FIG. 9 is a view illustrating a base according to the present invention.
Figure 10:
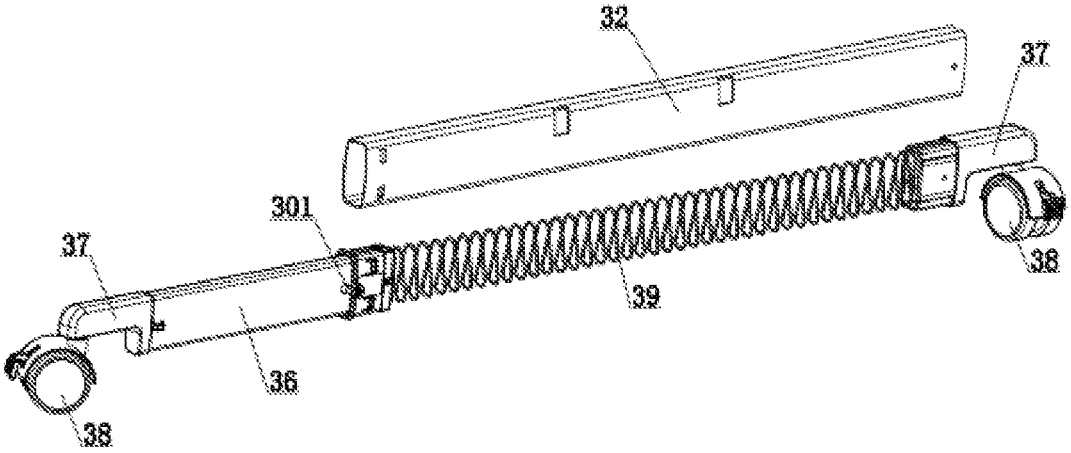
FIG. 10 is an exploded view illustrating structures of a support sleeve tube, an inner tube and a universal wheel connecting part according to the present invention.
Figure 11:
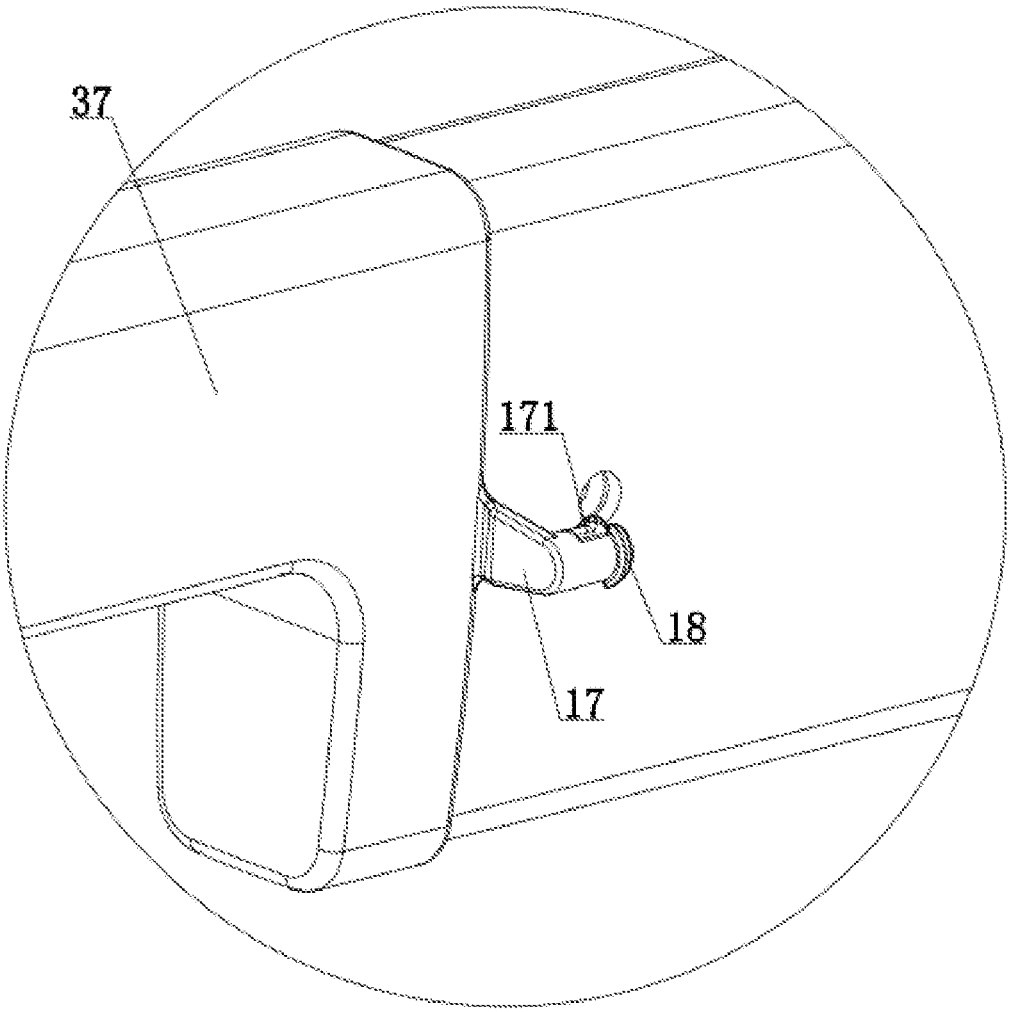
FIG. 11 is a partial enlarged view of C in FIG. 9.
Figure 12:
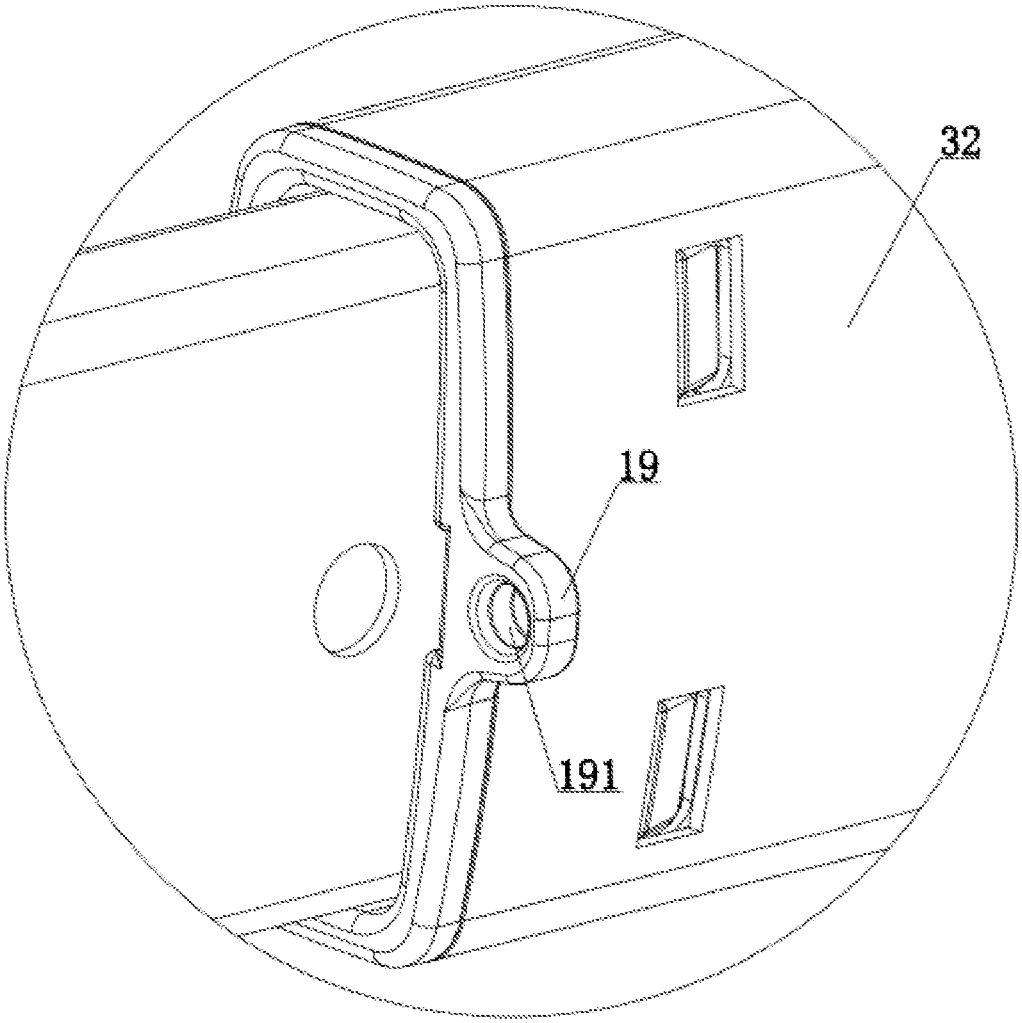
FIG. 12 is a partial enlarged view of D in FIG. 9.
Figure 13:
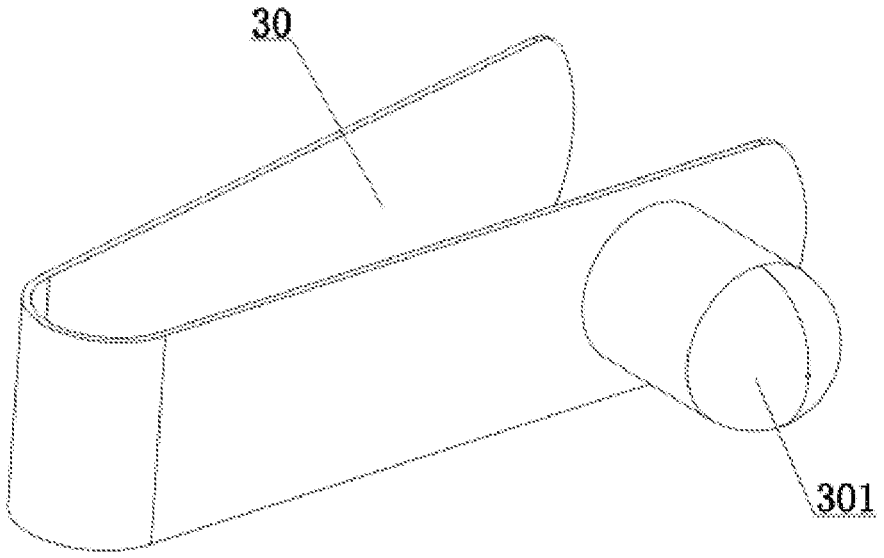
FIG. 13 is a view illustrating a V-shaped elastic piece according to the present invention.
Figure 14:
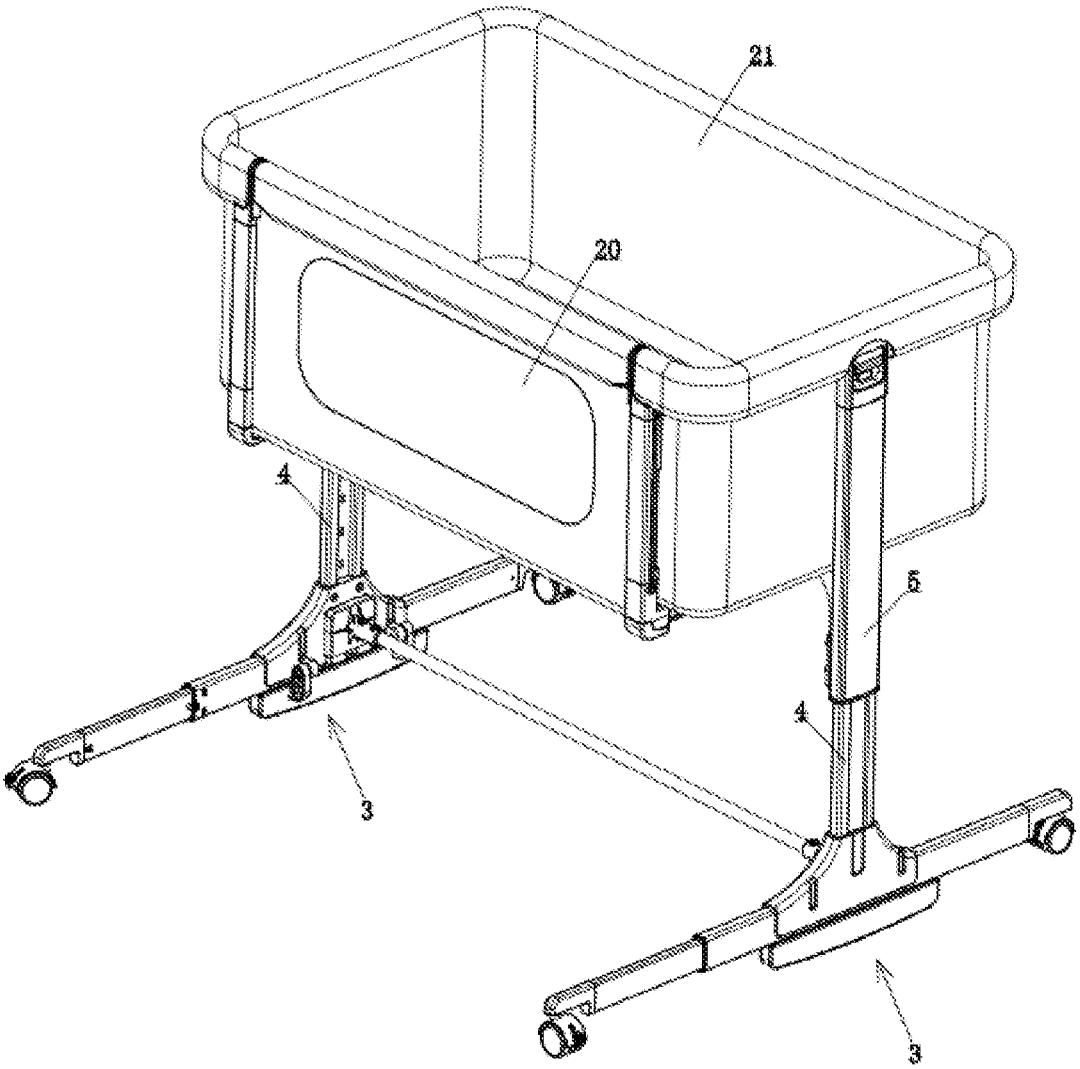
FIG. 14 is a view illustrating a structure with the cloth cover according to the present invention.
Figure 15:
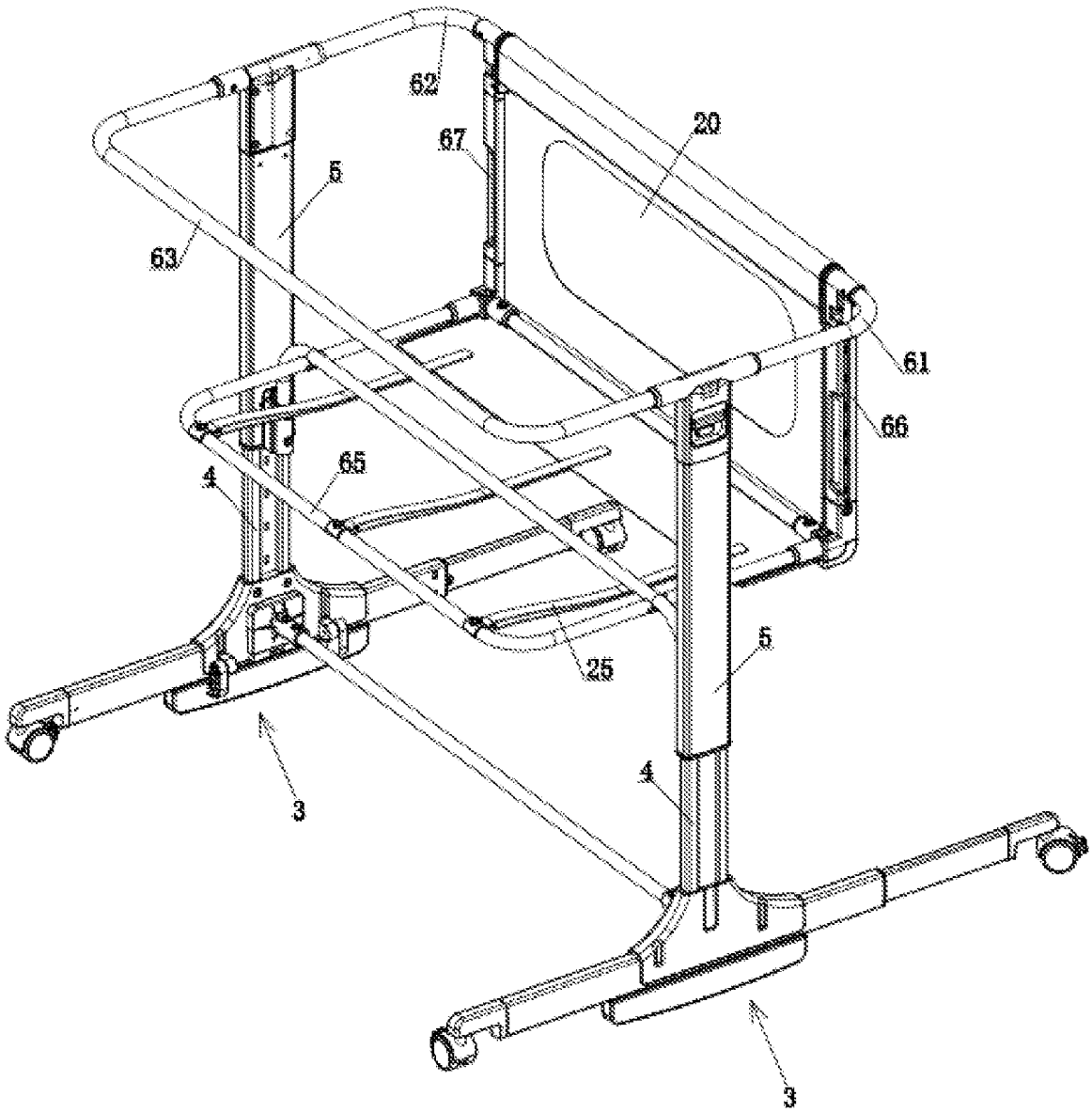
FIG. 15 is a view illustrating a structure after a rear cloth cover is removed according to the present invention.
Figure 16:
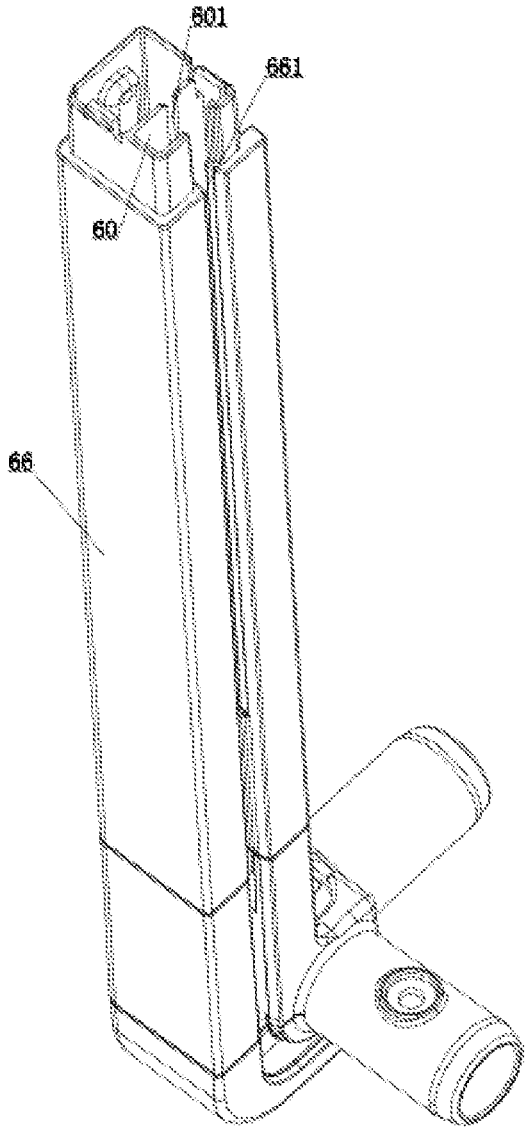
FIG. 16 is a view illustrating a structure of a left guide rail according to the present invention.
Figure 17:
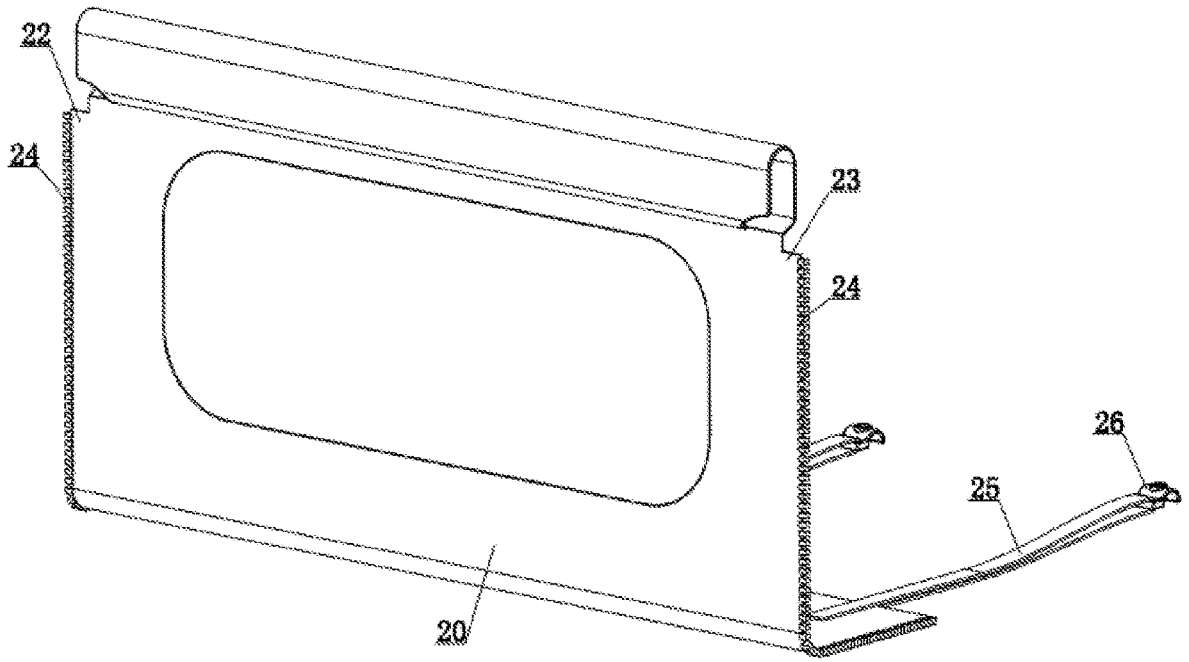
FIG. 17 is a view illustrating a structure of a front cloth cover according to the present invention.
Figure 18:
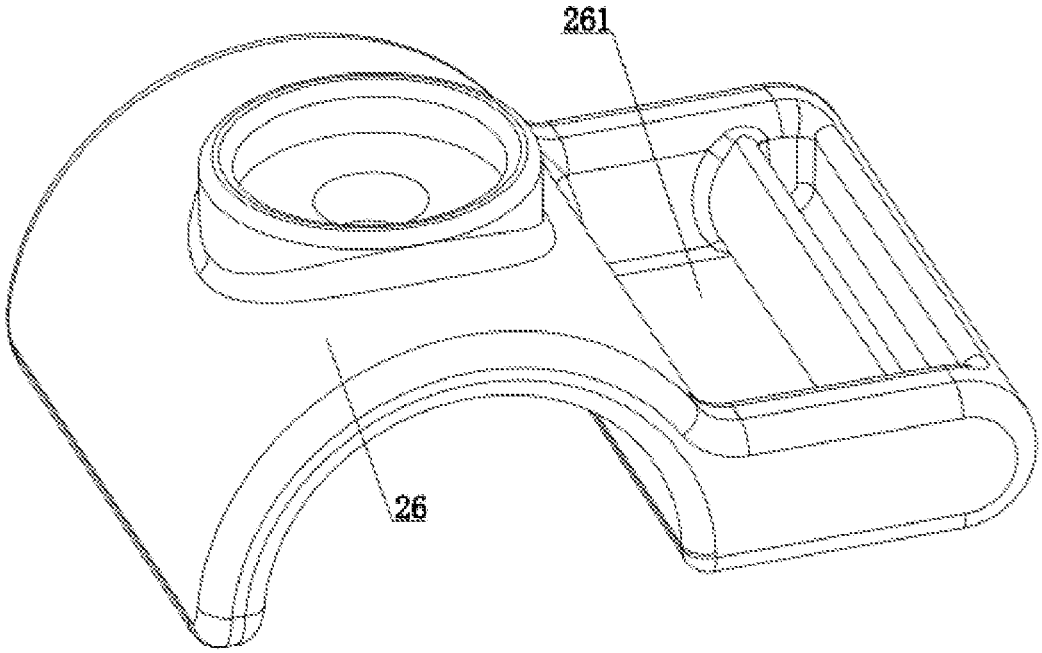
FIG. 18 is a view illustrating a structure of a winding member according to the present invention.

Referring to FIGS. 1 and 9, the base 3 includes a support seat 31, a support sleeve tube 32 and a support table 33. The support sleeve tube 32 is provided on a top surface of the support seat 31. The bottom of the support table 33 is provided with an opening groove 331. An upper part of the support sleeve tube 32 is clamped in the opening groove 331. An inner side surface of the support seat 31 is provided with two lower hinge lugs 311. An inner side surface of the support table 33 is provided with two upper hinge lugs 332 that are respectively hinged to the two lower hinge lugs 311. A bottom surface of the support seat 31 is a recessed arc surface. The inner side surface of the support table 33 is further provided with a second sleeve 34. A reinforcing rod 16 is provided between the second sleeve 34 on the left support part 1 and the second sleeve 34 on the right support part 2. Specifically, the inner side surface of the support table 33 is provided with the second sleeve part 35, and the second sleeve 34 is sleeved on the second sleeve part 35. The second sleeve 34 may be sleeved on the second sleeve part 35 through an I-slot, which is convenient for disassembly and assembly.

Referring to FIGS. 1 and 9 to 13, one end of the support sleeve tube 32 is provided therein with a telescopic inner tube 36. One end of the inner tube 36 is provided with a universal wheel connecting part 37. The other end of the support sleeve tube 32 is also provided with a universal wheel connecting part 37. The universal wheel connecting part 37 is provided with a universal wheel 38. The support sleeve tube 32 is provided therein with a compression spring 39 along a length direction. The compression spring 39 is located between the universal wheel connecting part 37 on the other end of the support sleeve tube 32 and the other end of the inner tube 36. The other end of the inner tube 36 is provided therein with a V-shaped elastic piece 30. An inner side surface of the V-shaped elastic piece 30 is provided with a clamping bead 301. An inner side surface of the other end of the inner tube 36 is provided with a clamping hole 361 for the clamping bead 301 to extend outward. The clamping bead 301 is located outside one end of the support sleeve tube 32. An inner side surface of the universal wheel connecting part 37 on one end of the inner tube 36 is provided with a connecting post 17 that is L-shaped in a top view. An inner end of the connecting post 17 is provided with a frustum part 18. A transverse part of the connecting post 17 is provided with a cut 171. The cut 171 divides the transverse part and the frustum part 18 of the connecting post 17 into two halves, respectively. An inner side surface of one end of the support sleeve tube 32 is provided with a lug 19. The lug 19 is provided with a circular hole 191 for inserting the two halves of the frustum part 18.

Referring to FIGS. 1, 9, 11 and 12, the support seat 31 can rotate 90° relative to the support sleeve tube 32. When the support seat 31 is parallel to the support sleeve tube 32, the support seat 31 is located on the floor, and the bassinet can swing. When the support seat 31 is perpendicular to the support sleeve tube 32, the universal wheel 38 is located on the floor, and the universal wheel 38 facilitates the movement of the bassinet. The telescopic manner of the inner tube 36 in the support sleeve tube 32 is an existing manner, which will not be repeated here. When the inner tube 36 is retracted, the two halves of the frustum part 18 can be inserted into the circular hole 191 and pass through the circular hole 191 to clamp a rear side surface of the circular hole 191. This minimizes the packaging size and ensures that the inner tube 36 and the support sleeve tube 32 are firmly connected.

Referring to FIGS. 1 and 14 to 18, the sleeping basket 6 is provided with a cloth cover. The cloth cover includes a front cloth cover 20 and a rear cloth cover 21. The rear cloth cover 21 is connected to the left front bending tube 61, the right front bending tube 62, the rear bending tube 63 and the support frame 65. An upper part of the front cloth cover 20 is sleeved on the lifting tube 64. Left and right ends of the front cloth cover 20 are respectively provided with a left zipper belt 22 and a right zipper belt 23. The left zipper belt 22 and the right zipper belt 23 are respectively provided with zipper teeth 24. The left guide rail 66 and the right guide rail 67 respectively have a hollow structure. The left guide rail 66 and the right guide rail 67 are respectively provided therein with a partition 60. The partition 60 is provided with a first cut 601 from top to bottom along a height direction. The inner side surface of the left guide rail 66 and the inner side surface of the right guide rail 67 are respectively provided with a second cut 661 from top to bottom. The left zipper belt 22 and the right zipper belt 23 pass through the corresponding second cut 661 and first cut 601. The zipper teeth 24 of the left zipper belt 22 and the zipper teeth 24 of the right zipper belt 23 are respectively located in the left guide rail 66 and the right guide rail 67. The zipper teeth 24 of the left zipper belt 22 block an outer side of the partition 60 in the left guide rail 66, and the zipper teeth 24 of the right zipper belt 23 block an outer side of the partition 60 in the right guide rail 67. The bottom of the front cloth cover 20 is wound around a front bottom surface of the support frame 65. The bottom of the front cloth cover 20 is provided with multiple elastic belts 25. A rear end of the support frame 65 is provided with multiple winding members 26. Each winding members 26 corresponds to one elastic belt 25. Each winding members 26 is provided with a winding hole 261. One end of each elastic belts 25 is connected to one side surface of the bottom of the front cloth cover 20. The other end of each elastic belts 25 passes through the corresponding winding hole 261 and is connected to the other side surface of the bottom of the front cloth cover 20.

Referring to FIGS. 1 and 14 to 18, the left zipper belt 22, the right zipper belt 23 and the zipper teeth 24 make the connection of the front cloth cover 20 to the left guide rail 66 and the right guide rail 67 easier. The zipper teeth 24 of the left zipper belt 22 block the outer side of the partition 60 in the left guide rail 66, and the zipper teeth 24 of the right zipper belt 23 block the outer side of the partition 60 of the right guide rail 67. In this way, the zipper teeth 24 can only be located in the corresponding left guide rail 66 and right guide rail 67, so as to ensure that the front cloth cover 20 does not fall off the left guide rail 66 and the right guide rail 67. To lower the front cloth cover 20 down, the lifting member 68 of the left guide rail 66 and the lifting member 68 of the right guide rail 67 are separated from the corresponding left guide rail 66 and right guide rail 67. Pulled by the multiple elastic belts 25, the front cloth cover 20 and the lifting tube 64 descend, and the bottom of the front cloth cover 20 is moved rearward accordingly.

The above described are merely specific implementations of the present invention, but the design concept of the present invention is not limited thereto. Any non-substantial changes made to the present invention based on the concept of the present invention should fall within the protection scope of the present invention.

What is claimed is:

1. A multipurpose bassinet, comprising a left support part and a right support part, wherein the left support part and the right support part are symmetrical;

the left support part and the right support part each comprise a base, a support rod, a sleeve rod and a sleeping basket; wherein a bottom of the support rod is connected to a top of the base;

a lower part of the sleeve rod is sleeved on an upper part of the support rod;

an upper part of the sleeve rod is provided with a lift button, and the lift button drives the sleeve rod to ascend and descend along the support rod;

the sleeping basket is provided between the sleeve rod of the left support part and the sleeve rod of the right support part;

the upper part of the sleeve rod is provided with an elastic lock member for locking the lift button;

the elastic lock member is movable in left and right directions;

the elastic lock member is pressed to unlock the lift button;

wherein the sleeve rod has an inner hollow structure;

a side surface of the sleeve rod is provided with a button port;

a baffle connected to the button port is provided in the upper part of the sleeve rod;

a height of the baffle is less than a height of the button port;

the lift button is provided in the upper part of the sleeve rod;

the lift button comprises a button part and a baffle part, wherein the button part is located above the baffle, and a bottom surface of the button part is configured to abut against a top surface of the baffle;

the baffle part is connected to the button part and is located inside the baffle;

the baffle part is provided with a movable space;

an inner side surface of the baffle part is provided with two symmetrical support plates, and the two symmetrical support plates are respectively located on two sides of the movable space;

the baffle is provided with a through groove, and the through groove is adapted to the elastic lock member;

the through groove is communicated with the movable space;

a first end of the elastic lock member passes through the through groove and the movable space, and a second other end of the elastic lock member is located outside the through groove;

the first end of the elastic lock member is provided with two symmetrical clamping parts; bottom surfaces of the two symmetrical clamping parts respectively abut against top surfaces of the two symmetrical support plates;

a first spring hole is provided in the middle of the first end of the elastic lock member; and a first spring is provided between the first spring hole and an inner side surface of the sleeve rod.

2. The multipurpose bassinet according to claim 1, wherein a housing is fixedly provided at the bottom of the sleeve rod;

a lifting block and a clamping block are provided in the housing;

the lifting block is configured to drive the clamping block to move in left and right directions;

an outer side surface of the clamping block is provided with a clamping plate;

an inner side surface of the support rod is provided with a plurality of clamping openings, and the plurality of clamping openings are spaced apart vertically;

one end of the clamping plate is clamped into the plurality of clamping openings;

a pull rope is provided between the baffle part and the lifting block;

a top surface of the lifting block is provided with a second spring hole;

an inner top surface of the housing is provided with a spring mounting part; and a second spring is provided between the spring mounting part and the second spring hole.

3. The multipurpose bassinet according to claim 2, wherein the lifting block comprises a head part and a driving part;

a junction of the head part and the driving part is a bending part;

a rear side surface of the bending part is a first inclined surface;

a top surface of the clamping block is a second inclined surface, and the second inclined surface fits the first inclined surface;

a top front side surface of the clamping block is provided with a protruding part;

a bottom surface of the protruding part is a third inclined surface;

an outer side surface of the protruding part abuts against an inner side surface of the driving part;

the inner side surface of the driving part is provided with a fourth inclined surface, and the fourth inclined surface fits the third inclined surface;

a third spring hole is provided on an inner side surface of the clamping block;

a third spring is provided between the third spring hole and the inner side surface of the housing;

a limit plate is provided on a lower front side surface of the clamping block;

the limit plate is located below the driving part;

the second spring hole is provided on the head part; and the pull rope is provided between the baffle part and the head part.

4. A multipurpose bassinet, comprising a left support part and a right support part, wherein the left support part and the right support part are symmetrical;

the left support part and the right support part each comprise a base, a support rod, a sleeve rod and a sleeping basket wherein a bottom of the support rod is connected to a top of the base;

a lower part of the sleeve rod is sleeved on an upper part of the support rod;

an upper part of the sleeve rod is provided with a lift button, and the lift button drives the sleeve rod to ascend and descend along the support rod;

the sleeping basket is provided between the sleeve rod of the left support part and the sleeve rod of the right support part;

the upper part of the sleeve rod is provided with an elastic lock member for locking the lift button;

the elastic lock member is movable in left and right directions; and the elastic lock member is pressed to unlock the lift button;

wherein the base comprises a support seat, a support sleeve tube and a support table; wherein the support sleeve tube is provided on a top surface of the support seat;

a bottom of the support table is provided with an opening groove;

an upper part of the support sleeve tube is clamped in the opening groove;

an inner side surface of the support seat is provided with two lower hinge lugs;

an inner side surface of the support table is provided with two upper hinge lugs, and the two upper hinge lugs are respectively hinged to the two lower hinge lugs;

a bottom surface of the support seat is a recessed arc surface;

the inner side surface of the support table is further provided with a second sleeve;

a reinforcing rod is provided between the second sleeve on the left support part and the second sleeve on the right support part, wherein a telescopic inner tube is provided in a first end of the support sleeve tube;

one end of the telescopic inner tube is provided with a universal wheel connecting part;

a second end of the support sleeve tube is provided with a universal wheel connecting part;

the universal wheel connecting part is provided with a universal wheel;

a compression spring is provided in the support sleeve tube along a length direction;

the compression spring is located between the universal wheel connecting part on the second end of the support sleeve tube and the second end of the telescopic inner tube;

a V-shaped elastic piece is provided in the second end of the telescopic inner tube;

an inner side surface of the V-shaped elastic piece is provided with a clamping bead;

an inner side surface of the second end of the telescopic inner tube is provided with a clamping hole, and the clamping bead extends outward from the clamping hole;

the clamping bead is located outside a first end of the support sleeve tube;

an inner side surface of the universal wheel connecting part on the first end of the telescopic inner tube is provided with a connecting post that is L-shaped in a top view;

an inner end of the connecting post is provided with a frustum part;

a transverse part of the connecting post is provided with a cut;

the cut divides the transverse part and the frustum part of the connecting post into two halves, respectively;

an inner side surface of a first end of the support sleeve tube is provided with a lug; and the lug is provided with a circular hole for inserting the two halves of the frustum part.

5. A multipurpose bassinet, comprising a left support part and a right support part, wherein the left support part and the right support part are symmetrical;

the left support part and the right support part each comprise a base, a support rod, a sleeve rod and a sleeping basket wherein a bottom of the support rod is connected to a top of the base;

a lower part of the sleeve rod is sleeved on an upper part of the support rod;

an upper part of the sleeve rod is provided with a lift button, and the lift button drives the sleeve rod to ascend and descend along the support rod;

the sleeping basket is provided between the sleeve rod of the left support part and the sleeve rod of the right support part;

the upper part of the sleeve rod is provided with an elastic lock member for locking the lift button;

the elastic lock member is movable in left and right directions; and the elastic lock member is pressed to unlock the lift button;

wherein the sleeping basket comprises a left front bending tube, a right front bending tube, a rear bending tube, a lifting tube, a support frame, a left guide rail and a right guide rail; wherein the rear bending tube is connected between an upper rear end of the sleeve rod of the left support part and an upper rear end of the sleeve rod of the right support part;

a first end of the left front bending tube is connected to an upper front end of the sleeve rod of the left support part, and a second end of the left front bending tube is connected to a top left end of the left guide rail;

a first end of the right front bending tube is connected to an upper front end of the sleeve rod of the right support part, and a second end of the right front bending tube is connected to a top right end of the right guide rail;

a bottom of the left guide rail and a bottom of the right guide rail are respectively connected to the support frame;

an inner side surface of the left guide rail and an inner side surface of the right guide rail are respectively provided with a lifting member;

the lifting tube is provided between the lifting member of the left guide rail and the lifting member of the right guide rail;

an inner side surface of the sleeve rod of each of the left support part and the right support part is provided with a first sleeve;

left and right ends of the support frame are respectively provided with a connecting rod;

the first sleeve is correspondingly sleeved on the connecting rod; and the first sleeve is correspondingly connected to the inner side surface of the sleeve rod;

wherein the sleeping basket is provided with a cloth cover;

the cloth cover comprises a front cloth cover and a rear cloth cover;

the rear cloth cover is connected to the left front bending tube, the right front bending tube, the rear bending tube and the support frame;

an upper part of the front cloth cover is sleeved on the lifting tube;

left and right ends of the front cloth cover are respectively provided with a left zipper belt and a right zipper belt;

the left zipper belt and the right zipper belt are respectively provided with zipper teeth;

the left guide rail and the right guide rail respectively have a hollow structure;

a partition is provided in the left guide rail and the right guide rail, respectively;

the partition is provided with a first cut from top to bottom along a height direction;

the inner side surface of the left guide rail and the inner side surface of the right guide rail are respectively provided with a second cut from top to bottom;

the left zipper belt and the right zipper belt correspondingly pass through the second cut and the first cut;

the zipper teeth of the left zipper belt and the zipper teeth of the right zipper belt are respectively located in the left guide rail and the right guide rail;

the zipper teeth of the left zipper belt block an outer side of the partition in the left guide rail, and the zipper teeth of the right zipper belt block an outer side of the partition in the right guide rail;

a bottom of the front cloth cover is wound around a front bottom surface of the support frame;

the bottom of the front cloth cover is provided with a plurality of elastic belts;

a rear end of the support frame is provided with a plurality of winding members;

each winding member corresponds to one elastic belt;

each winding member is provided with a winding hole;

a first end of each elastic belt is connected to a first side surface of the bottom of the front cloth cover; and a second end of each elastic belt correspondingly passes through the winding hole and is connected to the a second side surface of the bottom of the front cloth cover.

* * * * *